US006536864B2

(12) United States Patent
Kan

(10) Patent No.: US 6,536,864 B2
(45) Date of Patent: Mar. 25, 2003

(54) IMAGE FORMING APPARATUS

(75) Inventor: Shoichi Kan, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 20 days.

(21) Appl. No.: 09/789,615

(22) Filed: Feb. 22, 2001

(65) Prior Publication Data

US 2001/0017636 A1 Aug. 30, 2001

(30) Foreign Application Priority Data

| | | |
|---|---|---|
| Feb. 24, 2000 | (JP) | 2000-048330 |
| Feb. 24, 2000 | (JP) | 2000-052259 |
| Feb. 9, 2001 | (JP) | 2001-034086 |

(51) Int. Cl.[7] ..... B41J 2/165

(52) U.S. Cl. ..... 347/22; 347/23; 347/29; 347/30

(58) Field of Search ..... 347/22, 23, 29, 347/30, 32, 33, 37, 101, 104; 271/3.08, 3.18, 21; 101/483; 400/636

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,608,577 A | | 8/1986 | Hori | 347/66 |
| 4,723,129 A | | 2/1988 | Endo et al. | 347/56 |
| 4,740,796 A | | 4/1988 | Endo et al. | 347/56 |
| 4,825,231 A | * | 4/1989 | Nozaki | 347/30 |
| 5,831,644 A | * | 11/1998 | Kato | 347/104 |
| 5,883,645 A | * | 3/1999 | Ikado et al. | 347/30 |
| 6,132,027 A | * | 10/2000 | Suzuki et al. | 347/29 |

FOREIGN PATENT DOCUMENTS

| | | |
|---|---|---|
| EP | 0785 084 A2 * | 7/1997 |
| JP | 54-56847 | 5/1979 |
| JP | 59-123670 | 7/1984 |
| JP | 59-138461 | 8/1984 |
| JP | 60-71260 | 4/1985 |

OTHER PUBLICATIONS

09/789,613, Kan et al., "Image Forming Apparatus". Feb. 21, 2001.

* cited by examiner

*Primary Examiner*—Shih-wen Hsieh
(74) *Attorney, Agent, or Firm*—Fitzpatrick, Cella, Harper & Scinto

(57) ABSTRACT

An image forming apparatus for forming an image on a recording medium by a recording head includes a drive source rotatable in forward and reverse directions, and a drive changeover device for transmitting the driving force of the drive source. The drive changeover device drives a first mechanism by the rotation of the drive source in the forward direction, drives a second mechanism by the rotation of the drive source in the reverse direction, and prevents the malfunctioning of the second mechanism even when the first mechanism is driven by the rotation of the drive source in the reverse direction.

16 Claims, 11 Drawing Sheets

IMAGE FORMING APPARATUS

BACKGROUND OF THE INVENTION

1. Field of the Invention

This invention relates to an image forming apparatus for effecting the formation of images such as characters and figures on a recording medium such as a recording sheet being conveyed, and more particularly to an image forming apparatus in which, for example, a plurality of mechanisms such as a recording medium conveying mechanism and a recovering mechanism for an ink jet head for effecting image formation are driven by a single drive source.

2. Related Background Art

In recent years, with the spread of personal computers, word processors, facsimile apparatuses, etc. in offices, etc., various image forming apparatuses have been provided as the information output apparatuses of these apparatuses. Above all, image forming apparatuses such as ink jet printers for discharging ink to a recording medium to thereby form images such as characters and figures thereon are excellent in the dignity of image, printing speed, apparatus size, the balance of prices, etc. and are also easy to color and therefore are widely spread, and are used as image forming apparatuses in various fields.

Now, an image forming apparatus of this type such as an ink jet printer is generally provided with a recovering mechanism for removing thickened ink, dust, etc. adhering to the discharge ports of an ink jet head to thereby maintain a stable ink discharging function.

As such recovering mechanisms, there are known a capping mechanism having a cap for covering a surface in which the discharge ports of the ink jet head are disposed during non-recording to prevent the drying or evaporation of the ink, a wiping mechanism for removing the ink adhering to the surface in which the discharge ports of the ink jet head are disposed by the use of a blade or the like, a suction mechanism for sucking thickened ink, etc. from the discharge ports of the ink jet head or the vicinity thereof through the above-mentioned cap, etc. This suction mechanism brings the interior of the cap covering the surface in which the discharge ports are disposed into negative pressure by a pump to thereby discharge the ink from the discharge ports or the like.

Also, in the image forming apparatus, a mechanism for feeding and conveying recording mediums generally comprises an automatic sheet feeding mechanism containing a plurality of recording mediums such as recording sheets therein and separating and feeding them one by one therefrom, and a conveying mechanism disposed downstream thereof for conveying the recording medium in synchronism with image formation. The automatic sheet feeding mechanism is provided with a sheet feeding roller for pressure-contacting with the uppermost one of the stacked recording mediums and picking up and feeding the uppermost recording medium by the rotation thereof. A frictional member for usually producing an appropriate frictional force sheet feeding is provided in the pressure contact portion of this sheet feeding roller. Also, the conveying mechanism is provided with a conveying roller rotated by obtaining a driving force from a drive source, a driven roller cooperating with the conveying roller to nip the recording medium therebetween, and a paper path for the recording medium to pass between these rollers. In the sheet feeding and conveying mechanisms as described above, the recording medium fed by the sheet feeding roller is usually subjected to the adjustment (referred to also as the registration) of the conveyed position thereof in a nip portion comprised of the conveying roller and the driven roller, whereafter it is conveyed in synchronism, for example, with the scanning of the ink jet head, by the conveying roller and the driven roller, and image formation is effected.

The sheet feeding roller is generally formed with a dead zone portion which does not contact with the recording medium in conformity with rotation to decrease the conveying load thereof. This dead zone portion is designed to return to a rotated position opposed to a recording medium fed next when the sheet feeding roller effects rotation for sheet feeding and has finally effected one full rotation. Also, control is effected so that when the one full rotation of this sheet feeding roller is completed, the conveying roller on the downstream side may start the conveyance of the fed recording medium.

In the sheet feeding and conveying mechanisms as described above, motors are often used as drive sources for driving the sheet feeding roller and the conveying roller. In this case, there are a construction in which the sheet feeding roller and the conveying roller are driven by a motor, and a construction in which the driving of the sheet feeding roller and the conveying roller is controlled by discrete motors.

There is also known a construction in which a drive source for the pump in the above-described recovering mechanism is common to that for the conveying roller or the sheet feeding roller and the respective operations thereof are controlled, for example, by the changeover of the forward and reverse rotations of the motor. Specifically, the ordinary conveyance of the recording medium is effected by the forward rotation driving of the motor for driving the conveying roller, and the pump is operated by the driving of the motor in the reverse direction. In this case, the driving force is transmitted from the motor to the pump through a so-called one-way drive transmitting mechanism, whereby even when the driving of the motor is done in a direction in which the conveying roller is forwardly rotated, the driving force is prevented from being transmitted to the pump.

In the above-described construction, when the sheet feeding roller effects one full rotation for sheet feeding and performs the operation of the dead zone thereof returning to the initial position opposed to the uppermost recording medium (hereinafter referred to also as the resetting operation), the recording medium may sometimes be conveyed slightly excessively. At this time, the conveying roller on the downstream side is also being driven and as the result, the recording start position of the recording medium may sometimes deviate delicately.

Therefore, in the above-described construction wherein a common drive source is used for the conveying roller and the pump, i.e., the construction wherein the ordinary conveyance of the recording medium by the conveying roller is effected by only the driving of the drive source in the forward direction, and the driving thereof in the reverse direction is used for only the driving of the pump, it has heretofore been proposed regarding the fine adjustment of this recording start position to utilize a pendulum gear transmitting mechanism which is a one-way drive transmitting mechanism, and effect the minute reverse rotating operation of the conveying roller within the movement range of the pendulum of this pendulum gear transmitting mechanism (the dead zone range of transmission in which transmission is not effected), thereby effecting the adjustment of the recording start position.

However, in the case of a recording medium which is liable to slip during the feeding thereof by the sheet feeding roller depending on the relation between the conveyance distance of the recording medium by one full rotation of the sheet feeding roller and the distance of the paper path, or when the environment is a predetermined image forming environment regarding temperature, humidity, etc., it is sometimes the case that by the one full rotation of the sheet feeding roller, the recording medium does not arrive at the nip portion and the sheet feeding roller must be rotated by more than one full rotation. Even when the sheet feeding roller need thus be further rotated it has been necessary to further continue the rotation thereof in order to perform the above-described resetting operation of the dead zone portion of the sheet feeding roller.

Therefore, in the above-described adjustment of the recording start position, the reverse rotation of the conveying roller is effected more than in the case of ordinary fine adjustment, whereby the movement range of the pendulum of the pendulum gear transmitting mechanism exceeds the range of the dead zone of the transmission thereof and the pendulum may reach a position in which it comes into engagement with the driving mechanism for the suction pump. As the result, in some cases, the initial position regarding the pump driving has deviated from a predetermined position and has caused the malfunctioning of the pump driving.

FIGS. 9 to 13 of the accompanying drawings specifically illustrate this problem.

In these figures, the reference numeral 1 designates sheets which are recording mediums and are stacked and contained in a sheet feeding tray 101 (only the uppermost sheet is designated by 1*a*). The reference numeral 102 denotes a sheet feeding roller comprising an arcuate portion provided with a frictional member for contacting with the sheet 1 and imparting a sheet feeding force during sheet feeding, and a chord-shaped portion constituting a dead zone portion which does not contact with the sheet 1 in the initial position thereof, and having a D-shaped cross-section as a whole. In the shown example, this sheet feeding roller is designed to be capable of being driven independently of a conveying roller. Also, the initial position of the sheet feeding roller 102 can be confirmed by a sensor, not shown, for detecting the rotated position of the sheet feeding roller. This initial position refers to a position in which the dead zone portion of the sheet feeding roller 102 is opposed to the sheet 1 and the sheet feeding roller 102 does not contact with the sheet 1, and the operation of rotating the sheet feeding roller to this initial position is the above-described resetting operation (the position shown in FIGS. 12 and 13).

When the sheet feeding roller 102 begins to be rotated from this reset position in the direction of arrow A indicated in FIG. 9, etc., the sheets 1 upwardly biased by a spring or the like, not shown, are brought into pressure contact with the arcuate portion of the sheet feeding roller 102, whereby the uppermost sheet 1*a* is fed in the direction of arrow B indicated in FIG. 9, etc. by a frictional force acting between it and the arcuate portion. This fed sheet 1*a* is then guided by a paper pan 309 and directed to the conveying roller 302. At this time, the rotation of the conveying roller 302 is stopped, and the fed uppermost sheet 1*a* is rammed against a nip portion formed by the conveying roller 302 and a driven roller 307 and a loop of a moderate size is formed, whereby the registration of the sheet is effected.

However, due to the various causes set forth above, as shown in FIG. 9, the sheet 1*a* may sometimes not arrive at the nip portion by the one full rotation of the sheet feeding roller 102. In such case, sheet detecting means (not shown) for detecting the arrival of the sheet at a predetermined position on a sheet path detects that the sheet has not yet arrived at the nip portion. In response to this detection, the second one full rotation of the sheet feeding roller 102 is started.

Thereby, as shown in FIG. 10, the leading end of the uppermost sheet 1*a* arrives at the nip portion, and a loop of a moderate size is formed and registration becomes effected. Usually, the distance deficient for the sheet to arrive at the nip portion by the first one full rotation is relatively smaller than the amount by which the sheet is fed by the first one full rotation of the sheet feeding roller and therefore, it is often the case that the state in which the sheet has arrived at the nip portion is immediately after the second one full rotation of the sheet feeding roller 102 has begun. Thus, the amount by which the sheet 1*a* is fed from this state by the sheet feeding roller 102 is relatively great.

That is, as shown in FIG. 11, in response to the arrival of the sheet at the nip portion, the conveying roller 302 begins to be rotated in the direction of arrow C indicated in FIG. 11, whereby the sheet 1*a* which has so far bumped against the nip portion is conveyed to a recording position on a platen 301 opposed to a recording head 201, and at this time, the sheet feeding roller 102 also effects a relatively great amount of rotation in the direction of arrow A as described above. As the result, as shown in FIG. 11, the sheet 1*a* passes the recording start position by the recording head 201 and is conveyed farther.

In contrast, in the conveying mechanism, as described above, the reverse rotation of the conveying roller is effected and the control of returning the sheet to the recording position is effected. That is, as shown in FIG. 12, after the resetting operation of the sheet feeding roller 102 is completed, the conveying roller 302 is rotated in a reverse direction (the direction of arrow D indicated in FIG. 12) to thereby move the uppermost sheet 1*a* in the direction of arrow E in order to return the too much fed uppermost sheet 1*a* to the recording position (a cue position).

At this time, in the construction as shown in FIG. 12 wherein a motor which is the drive source of the conveying roller 302 is used also as the drive source of a suction recovery pump, an LF pendulum arm 310 which is a one-way drive transmitting mechanism for the changeover of the driving thereof begins to rotate in the direction of arrow F.

However, as described with reference to FIG. 11, during sheet feeding, the sheet is fed relatively much past the cue position and the amount of return of the sheet by the reverse rotation of the sheet feeding roller 102 is great and therefore, the above-mentioned rotation of the LF pendulum arm does not fall within the transmission dead zone range, and when as shown in FIG. 13, the uppermost sheet 1*a* is returned to the cue position, an LF planetary gear 311 is rotated to a position in which it is engaged with a pump transmission gear 509. As the result, a driving force is transmitted to the pump transmission gear 509 and a pump cam 510 is rotated, whereby a detected member 510*a* provided on the pump cam 510 may sometimes arrive at the position of an initial position detecting sensor 550. In such case, the malfunctioning that the pump cam detects the arrival at the initial position and the sequence thereafter is started may be caused. For example, even if an attempt is made to effect the detection of the sensor for the initialization of another cam in a state in which the pump cam is detecting the detecting sensor, it may become impossible and malfunctioning may sometimes occur.

In order to solve such a problem, it is heretofore known to use discrete drive sources for the conveyance of the sheets and for the pump of the recovery system, and to discretely provide a complicated changeover mechanism with a carriage carrying a recording head thereon as the trigger for the changeover of the drive transmission to the pump. However, this has left problems in respect of the downsizing, simplification, lower cost, etc. of the apparatus.

SUMMARY OF THE INVENTION

It is an object of the present invention to provide an image forming apparatus in which a first mechanism is driven by the rotation of a drive source in a forward direction and a second mechanism is driven by the rotation of the drive source in a reverse direction and even when the first mechanism is driven by the rotation of the drive source in the reverse direction, the malfunctioning of the second mechanism is prevented.

It is another object of the present invention to provide an image forming apparatus having a drive source rotatable in forward and reverse directions, and drive changeover means for transmitting the driving force of the drive source, wherein the drive changeover means drives a first mechanism by the rotation of the drive source in the forward direction, and drives a second mechanism by the rotation of the drive source in the reverse direction, and even when the first mechanism is driven by the rotation of the drive source in the reverse direction, the malfunctioning of the second mechanism is prevented.

DESCRIPTION OF THE PREFERRED EMBODIMENTS

Some embodiments of the present invention will hereinafter be described with reference to the drawings.

<First Embodiment>

Figure 1:
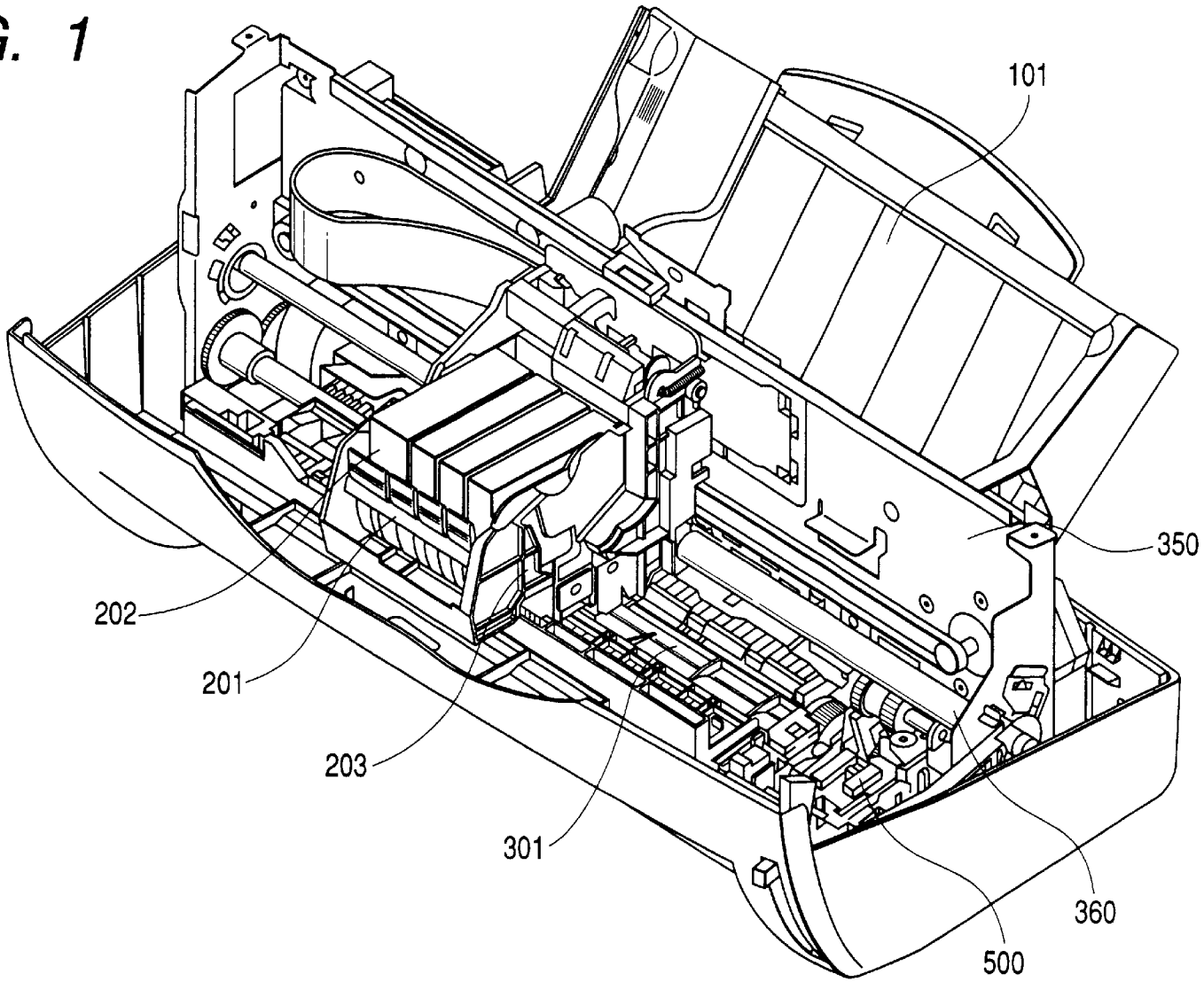
FIG. 1 is a pictorial perspective view showing a form of an ink jet printer according to an embodiment of the present invention.
Figure 2:
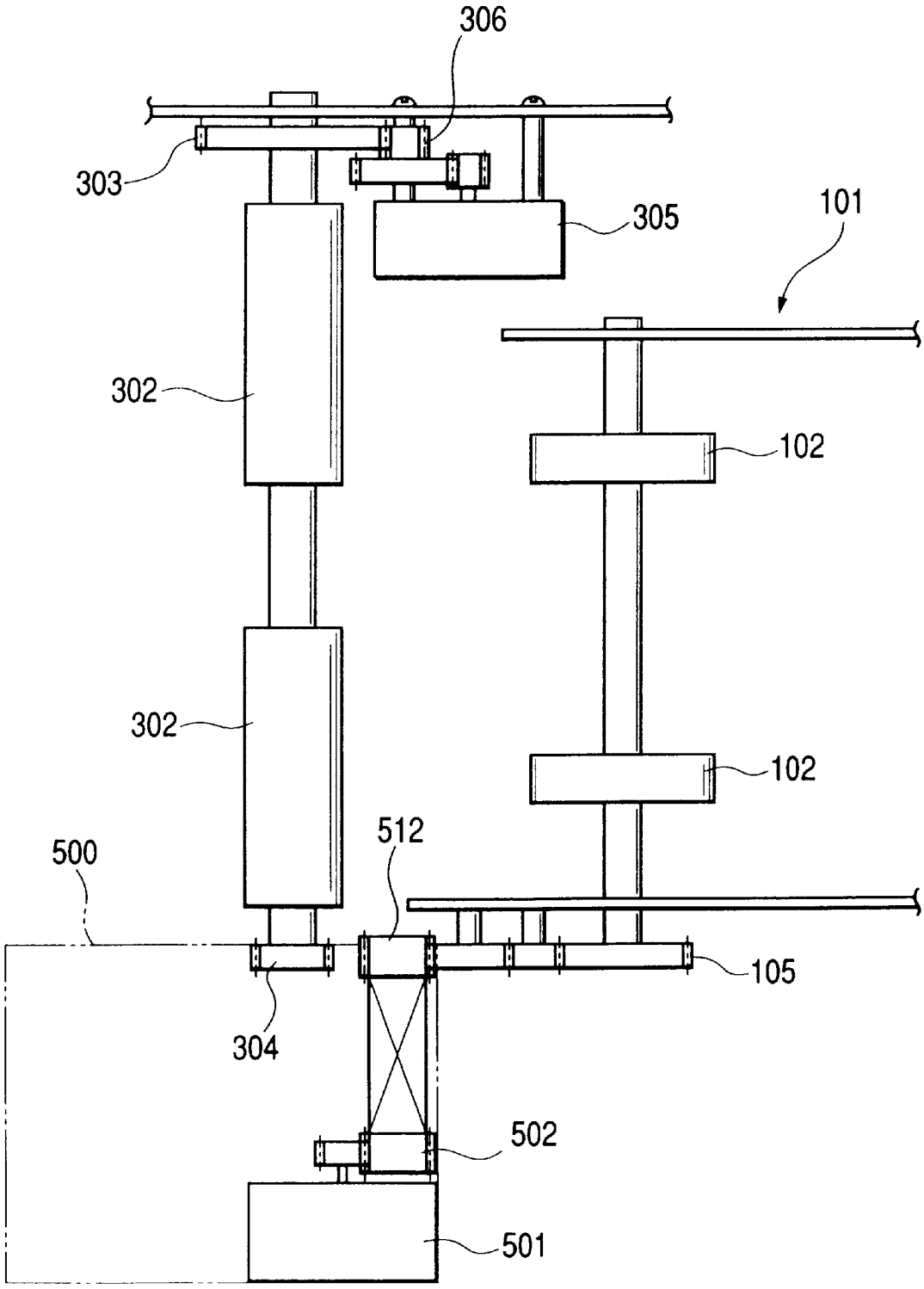
FIG. 2 is a plan view typically showing the rough construction of the feeding and conveyance of a recording sheet in the printer shown in FIG. 1.
Figure 3A:
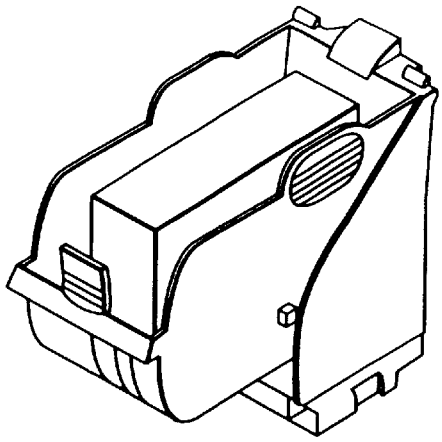
FIGS. 3A, 3B and 3C are perspective views showing head cartridges in which a recording head and an ink tank usable in the ink jet printer are made integral with each other, FIG. 3A showing a black cartridge, FIG. 3B showing a color cartridge, and FIG. 3C showing a photo-cartridge.
Figure 3B:
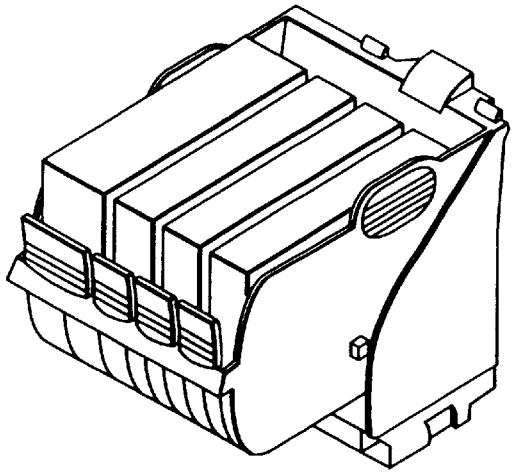
Figure 3C:
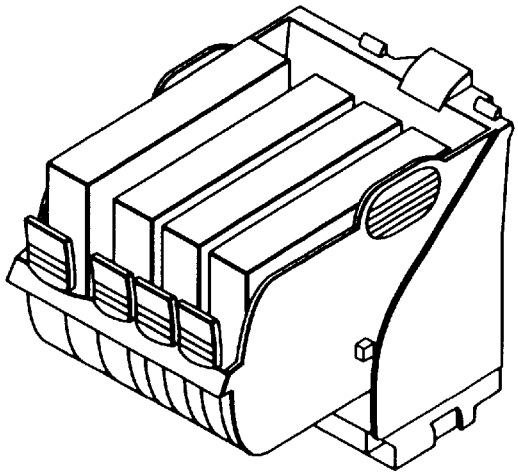

FIG. 1 is a pictorial perspective view showing a form of an image forming apparatus in or to which the present invention is suitably carried out or applied. FIG. 2 is a schematic plan view showing a sheet feeding mechanism for feeding recording mediums (sheets) set on a sheet feeding tray 101 shown in FIG. 1 onto a platen 301, and a recovery system 500 for a recording head including a cam device and provided with drive changeover means. FIGS. 3A, 3B and 3C are perspective views showing head cartridges in which a recording head and an ink tank are made integral with each other, FIG. 3A showing a black cartridge, FIG. 3B showing a color cartridge, and FIG. 3C showing a photo-cartridge. The shape of the interior of discharge ports and the construction of ink flow paths differ among a black head, a color head and a photo-head. These recording heads are selectively mounted on a carriage 203 in conformity with the purpose of printing.

The present embodiment, as shown in FIGS. 1 and 2, is comprised of a sheet feeding roller 102 for feeding the sheets set on the sheet feeding tray 101, a conveying roller 302 for conveying the sheet fed by the sheet feeding roller 102 onto the platen 301, a carriage 203 carrying thereon recording heads 201 provided with a discharging portion for discharging ink and an ink tank 202, a scanning rail 360 for slidably supporting the carriage 203, a recovery system 500 provided with recovering means for recovering the plurality of recording heads 201 carried on the carriage 203 and having drive changeover means for changing over the drive from the conveying roller 302, and a chassis 350.

In the image forming apparatus constructed as described above, when one of the sheets set on the sheet feeding tray 101 is conveyed onto the platen 301 by the sheet feeding roller 102 and the conveying roller 302, the ink is discharged to this sheet from the plurality of recording heads 201 carried on the carriage 203 reciprocally moved along the scanning rail 360, whereby an image is formed on the sheet.

Description will now be made of a sheet feeding mechanism for conveying the sheets set on the sheet feeding tray 101 shown in FIG. 1 onto the platen 301.

A driving force created by the rotational force of an LF motor 305 is transmitted through a reduction gear 306 to a conveying gear 303 fixed to one end of the conveying roller 302, whereby the conveying roller 302 is rotated.

On the other hand, an LF output gear 304 is fixed to the other end of the conveying roller 302, and a driving force created by the rotation of the conveying roller 302 is transmitted to the recovery system 500 by the LF output gear 304 and effects the driving of a pump portion.

Also, an AP motor 501 which corresponds to a second drive source is carried on the recovery system 500, and a driving force created by the rotation of the AP motor 501 is transmitted to a sheet feeding gear 105 through a drive changeover mechanism 502 which is one-way drive transmitting means.

When the drive is transmitted to the sheet feeding gear 105, the sheet feeding roller 102 is rotated, and by this rotation, one of the sheets set on the sheet feeding tray 101 is fed to the conveying roller 302. Thereafter, the sheet fed to the conveying roller 302 is conveyed onto the platen 301 by the conveying roller 302.

The recovery system 500 shown in FIGS. 1 and 2 will now be described.

Figure 4:
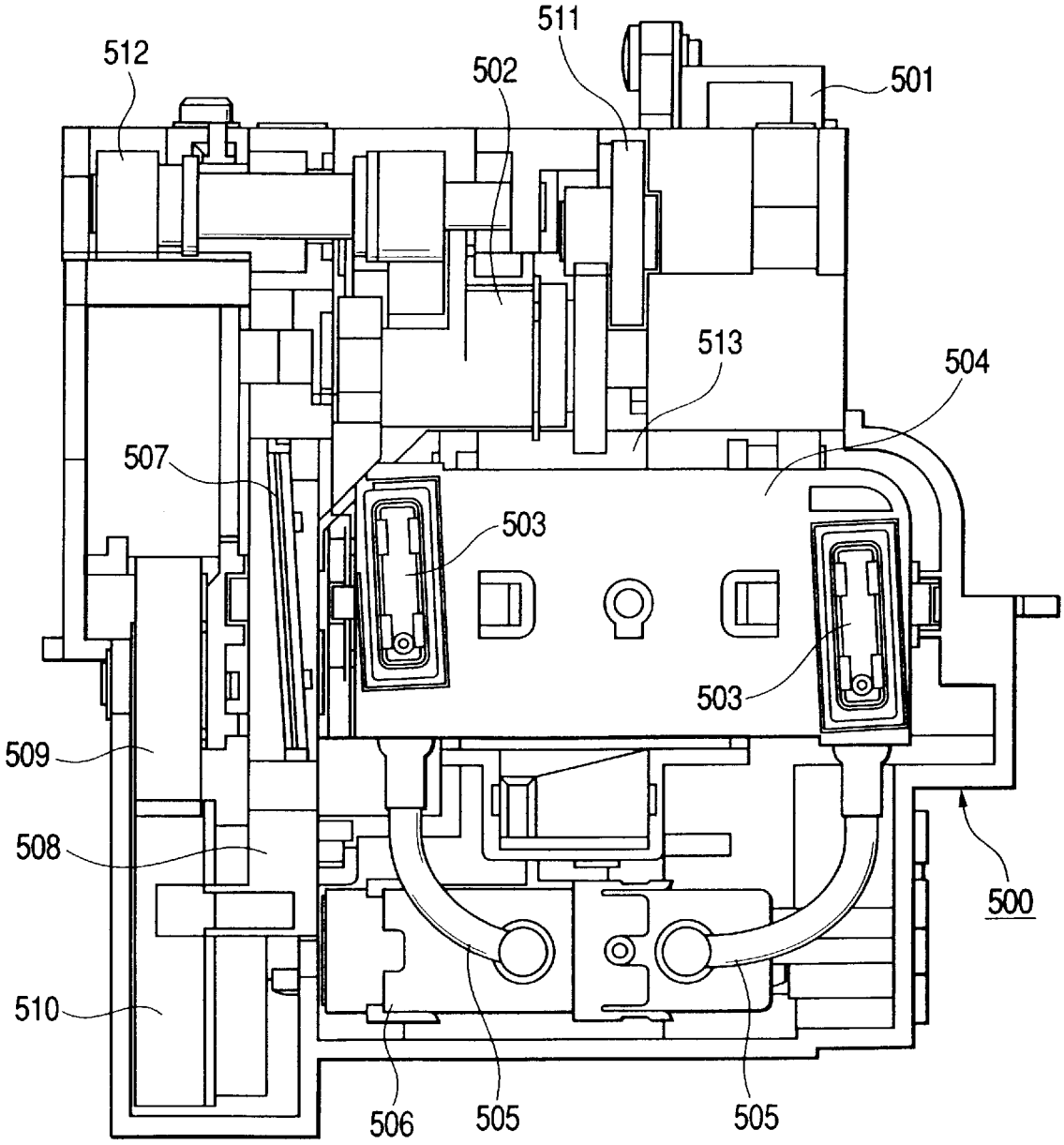
FIG. 4 is a block diagram showing the construction of the control circuit of the recording apparatus shown in FIG. 1.

FIG. 4 is a pictorial plan view showing an embodiment of the recovery system shown in FIGS. 1 and 2.

As shown in FIG. 4, this embodiment has a cap holder 504 which is cap means for covering the discharge port forming surfaces of the recording heads during non-recording by caps 503 to prevent the drying or evaporation of the ink, and the caps 503 are brought into close contact with and spaced apart from the discharge port forming surfaces of the two recording heads, whereby capping is effected. It also has pump means 506 for sucking the ink or the like from the discharge ports of the recording heads and the vicinity thereof through the cap holder 504 and joint tubes 505, and wiping means 508 for removing the ink adhering to the discharge port forming surfaces of the recording heads by a blade 507. In the present embodiment, when the drive from the LF output gear 304 (see FIG. 2) is transmitted to a pump cam 510 through a pump transmission gear 509, the pump means 506 is driven.

Further in the present embodiment, when the drive from the AP motor 501 which is a second drive source is transmitted to a sheet feeding output gear 512 through a driving reduction gear 511 and the drive changeover mechanism 502, the sheet feeding roller 102 (see FIG. 2) is driven through the sheet feeding gear 105 (see FIG. 2).

Also, when the driving force of the AP motor 501 is transmitted through the drive changeover mechanism 502 to a cap cam 513 for driving the cap means 504 and the wiping means 508, the cap means 504 and the wiping means 508 are driven.

Figure 5:
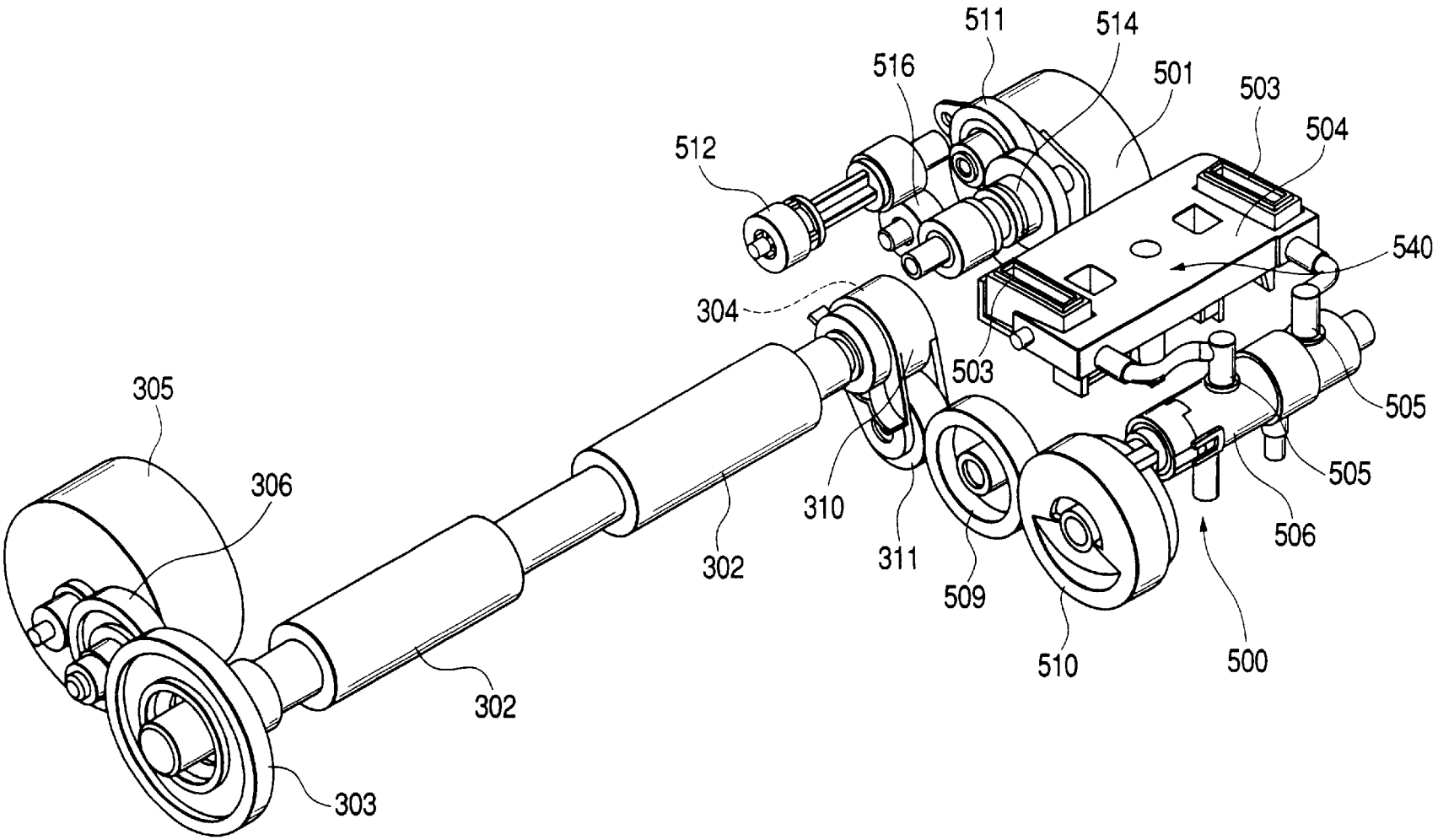
FIG. 5 is a typical perspective view illustrating a construction for transmitting a driving force from the drive source of a conveying roller in an embodiment of the present invention to a pump.

Reference is now made to FIG. 5 to describe a construction for transmitting the drive from the drive source of the conveying roller to the pump portion.

In FIG. 5, by a driving force created in the LF motor 305, the conveying roller 302 is rotated through the reduction gear 306 and the conveying gear 303. On the other end of the conveying roller 302, there is provided a pendulum-shaped gear transmission mechanism (hereinafter referred to as the LF pendulum mechanism) including the LF output gear 304 as a base gear, an LF pendulum arm 310 mounted for pivotal movement relative to the LF output gear 304, and an LF planetary gear 311 mounted on the LF pendulum arm 310. This LF pendulum mechanism is one-way drive transmitting means for effecting the intermission of the drive to the pump transmission gear 509, and the LF planetary gear 311 meshes with the pump transmission gear 509, whereby the drive created in the LF motor 305 is transmitted to the pump cam 510 and thus, the pump means 506 is driven.

It should be noted here that design is made such that the direction of rotation of the LF motor 305 for moving the LF pendulum mechanism to the pump transmission gear 509 side is opposite to the direction of rotation for the ordinary conveyance of the sheet by the conveying roller 302.

Figure 6A:
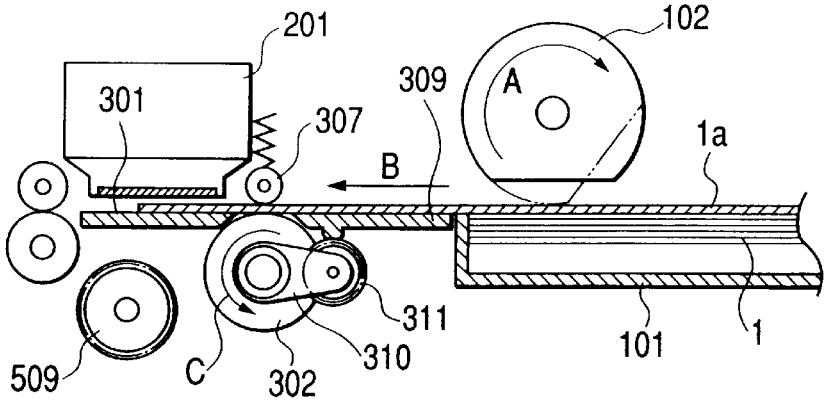
FIGS. 6A, 6B and 6C are typical side views illustrating the relation between the sheet feeding sequence in a first embodiment of the present invention and the driving force transmission to pump means.
Figure 6B:
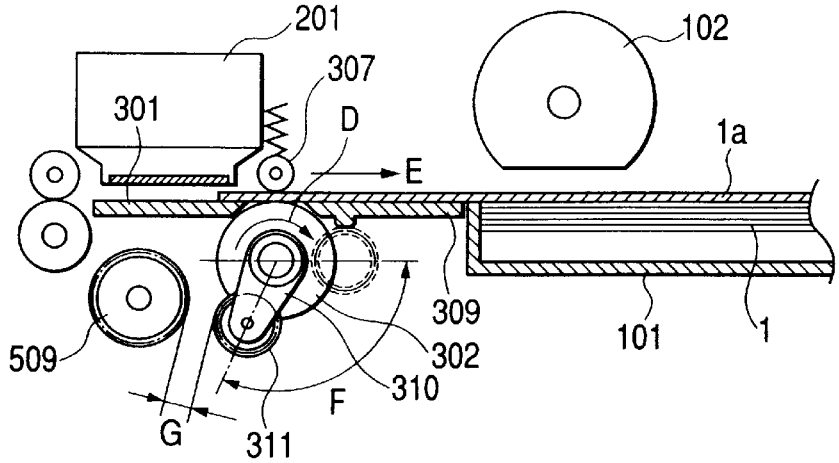
Figure 6C:
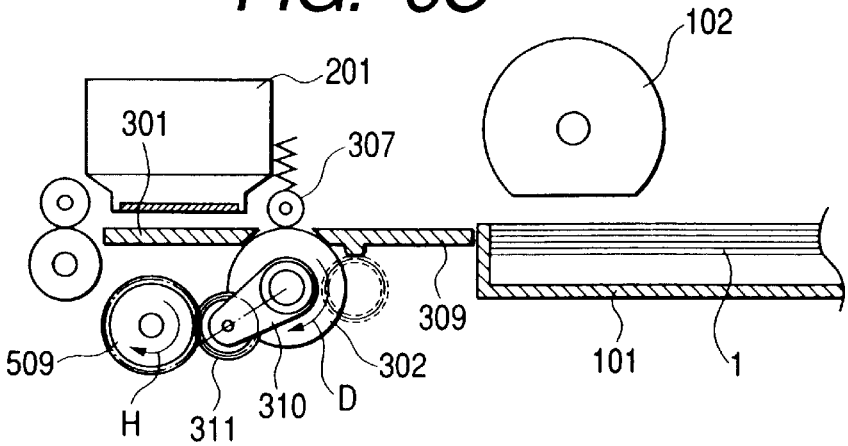

FIGS. 6A, 6B and 6C are typical side views illustrating the relation between the sheet feeding sequence in the present embodiment and the drive transmission to the pump means.

In FIG. 6A, the sheet feeding roller 102 is rotated in the direction of arrow A and by the frictional force thereof, the uppermost sheet 1*a* of the stacked sheets is fed in the direction of arrow B. At this time, the conveying roller 302 is being rotated in the direction of arrow C and therefore conveys the uppermost sheet 1*a* directed to the nip position to a recording position on the platen 301 and also rotates the LF pendulum mechanism including the LF pendulum arm 310 pivotally mounted on the end portion of the conveying roller 302 and the LF planetary gear 311 mounted on the LF pendulum arm 310 in the direction of arrow C. As is apparent from FIG. 6A, the LF pendulum mechanism is kept at the position farthest from the pump transmission gear 509 as long as the conveying roller 302 continues to be rotated in the conveying direction (the direction of arrow C).

Here, when the uppermost sheet 1*a* that has been fed too much by the amount of rotation of the sheet feeding roller 302 for resetting is to be returned to the cue position for the recording heads 201, the conveying roller 302 is rotated in a reverse direction (the direction of arrow D) as shown in FIG. 6B to thereby move the uppermost sheet 1*a* in the direction of arrow E. At this time, the LF pendulum arm 310 is pivotally moved in the direction of arrow D with the rotation of the conveying roller 302, but in the present embodiment, the drive dead zone range of the LF pendulum arm 310 (the amount of rotation until the drive is transmitted from the position farthest from the pump transmission gear 509 to the pump transmission gear 509) is designed sufficiently large relative to the amount of rotation (the amount of rotation F in FIG. 6B) of the LF pendulum arm 310 due to the amount of rotation of the conveying roller 302 when the sheet is returned to the cue position and therefore, as is apparent from FIG. 6B, the LF planetary gear 311 and the pump transmission gear 509 have a gap G therebetween and do not mesh with each other.

The aforementioned amount of rotation of the conveying roller 302 when the sheet is returned to the cue position is determined in each construction from the amount of effective feeding (the circumferential length of the arcuate portion) by the one full rotation of the sheet feeding roller 102, the distance from the stacked position of the sheets to the cue position, the amount of feeding by the conveying roller 302, etc. and therefore, an amount of rotation sufficiently great relative to this amount is used as the dead zone range of the LF pendulum, whereby it can be carried out with respect to each construction.

Next, when as shown in FIG. 6C, the conveyance of the sheet is not effected, the conveying roller 302 continues to be rotated in the reverse direction (the direction of arrow D), whereby the LF pendulum arm 310 is likewise pivotally moved in the direction of arrow D, and the LF planetary gear 311 comes into meshing engagement with the pump transmission gear 509 and the drive is transmitted to the pump means.

<Second Embodiment>

Figure 7:
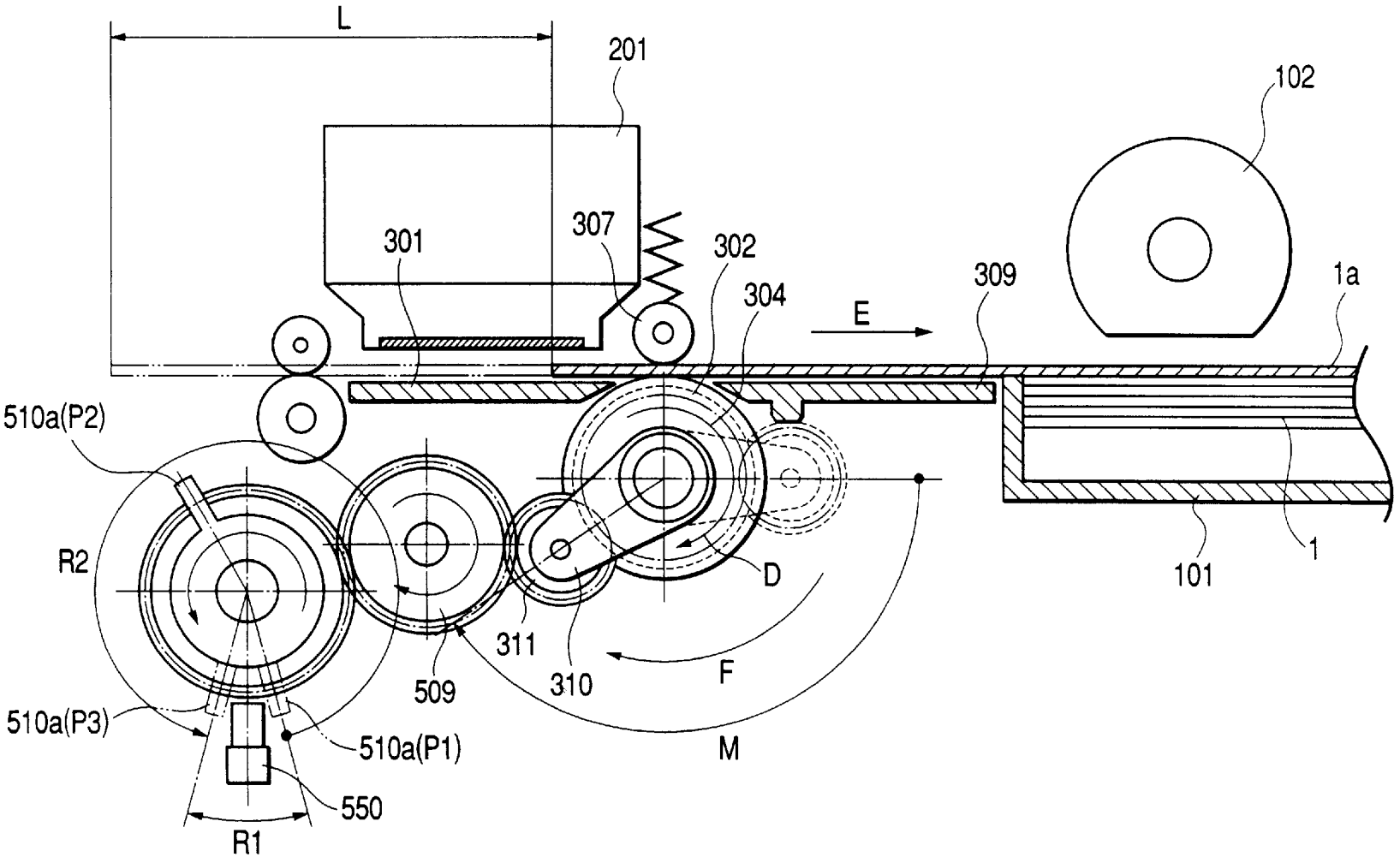
FIG. 7 is a typical side view illustrating the relation between the sheet feeding sequence in a second embodiment of the present invention and the driving force transmission to pump means.

A second embodiment of the present invention will now be described with reference to FIG. 7. FIG. 7 illustrates the operation of conveying the sheet to the cue position by the conveying roller when the sheet is conveyed too much by the sheet feeding roller. In the present embodiment, design is made such that even if the driving force is transmitted to the pump cam 510 by this conveyance, a detected member provided on the pump cam 510 is not detected by an initial position detecting sensor.

In FIG. 7, the uppermost sheet 1*a* is reversely conveyed, for example, from a position to which it has been fed excessively by the sheet feeding roller 102 effecting two full rotations to the recording start position of the recording heads 201 (the cue position) by the driving of the conveying roller 302 in the reverse direction (the direction of arrow D in FIG. 7). At this time, the LF pendulum arm 310 is rotated in the direction of arrow F in FIG. 7 by the above-mentioned relatively great amount of return with the rotation of the conveying roller 302, and the LF planetary gear 311 thereof arrives at a position in which it meshes with the pump transmission gear 509. In response to this meshing engagement, the pump cam 510 begins to rotate. A detected member 510*a* to be detected by an optical type initial position detecting sensor 550 is provided on the pump cam 510, and by the rotation of the pump cam 510, this member intercepts the light of the sensor 550, whereby the initial position of the pump cam 510 is detected.

In the present embodiment, regarding the amount of rotation of the pump cam 510, design is made such that the amount of rotation necessary to be rotated over a range (the non-intercepting range R2 indicated in FIG. 7) outside the range detected as the initial position by the rotation of the detected member 510*a* (the intercepting range R1 indicated in FIG. 7) becomes sufficiently greater than the amount by which the pump cam 510 is rotated by the above-mentioned reverse conveyance of the sheet to the cue position by the conveying roller 302. Further, the initial stop position (home position) of the pump cam 510 is determined to be in the vicinity of the initial position detecting point (the intercepting range) by the detecting sensor 550. Specifically, the above-described construction can be realized by appropriately adjusting the gear ratio of the gears 311, 509, etc. More specifically, such an amount of rotation that, as described above, the detection of the detected member 510*a* by the sensor 550 is not effected can also be set by the return conveyance of the sheet effected when, for example, the maximum amount of excessive feeding when the sheet feeding roller 102 effects at least two full rotations and the sensor for detecting the arrival of the sheet at the nip portion detects the arrival thereof is known in advance.

By the above-described construction, even if the pump cam 510 is driven by the driving of the conveying roller 302 in the reverse direction caused by the reverse conveyance of the uppermost sheet 1*a* to the cue position, the malfunctioning by the detected member 510*a* of the pump cam 510 coming to the intercepting range of the detecting sensor 550 by that rotation can be prevented.

In the present embodiment, the pump cam which has deviated from the home position by the reverse conveyance as described above prepares for the next pumping operation by driving the conveying roller 302 in the reverse direction and retaking the initial centering of the pump cam 510 after the recording on the fed sheet is terminated and the sheet is discharged out of the apparatus.

The above-described construction or the respective amounts of rotation will be described in greater detail below. When the amount of rotation of the conveying roller 302 necessary to return the uppermost sheet 1*a* conveyed by the amount of rotation required to reset the sheet feeding roller 102 to the recording start position (a distance L indicated in FIG. 7) is defined as X1 and the amount of rotation of the conveying roller 302 required for the maximum amount of movement (a distance M indicated in FIG. 7) of the LF pendulum arm 310 is defined as X2 and the amount of rotation of the conveying roller 302 required for the movement of the pump cam 510 in the range (R2 in FIG. 7) outside the detection range (R1 in FIG. 7) of the initial position thereof is defined as X3, design is made such that the relation that $$X1<<(X2+X3)$$

is established.

<Third Embodiment>

Figure 8:
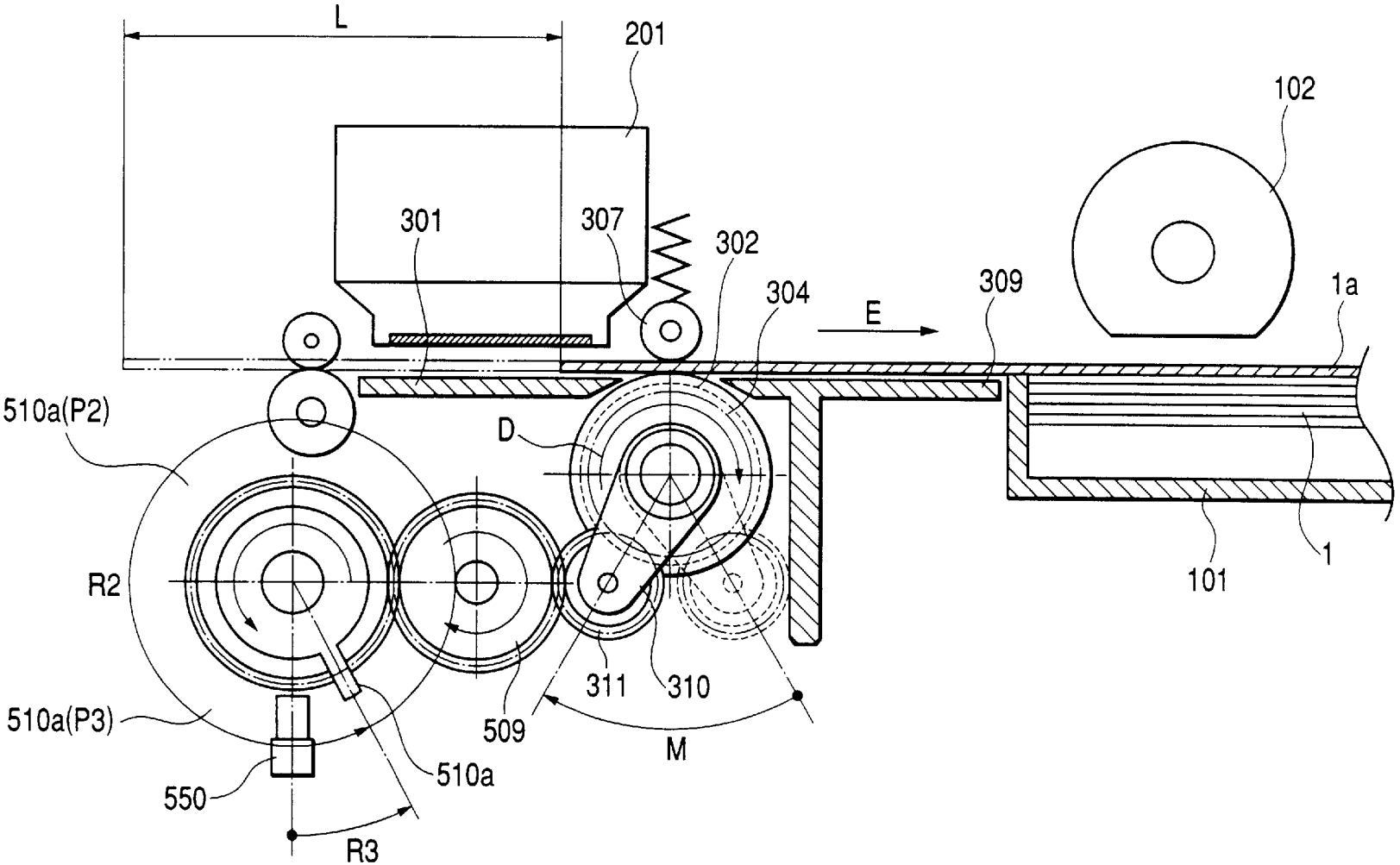
FIG. 8 is a typical side view illustrating the relation between the sheet feeding sequence in a third embodiment of the present invention and the driving force transmission to pump means.
Figure 9:
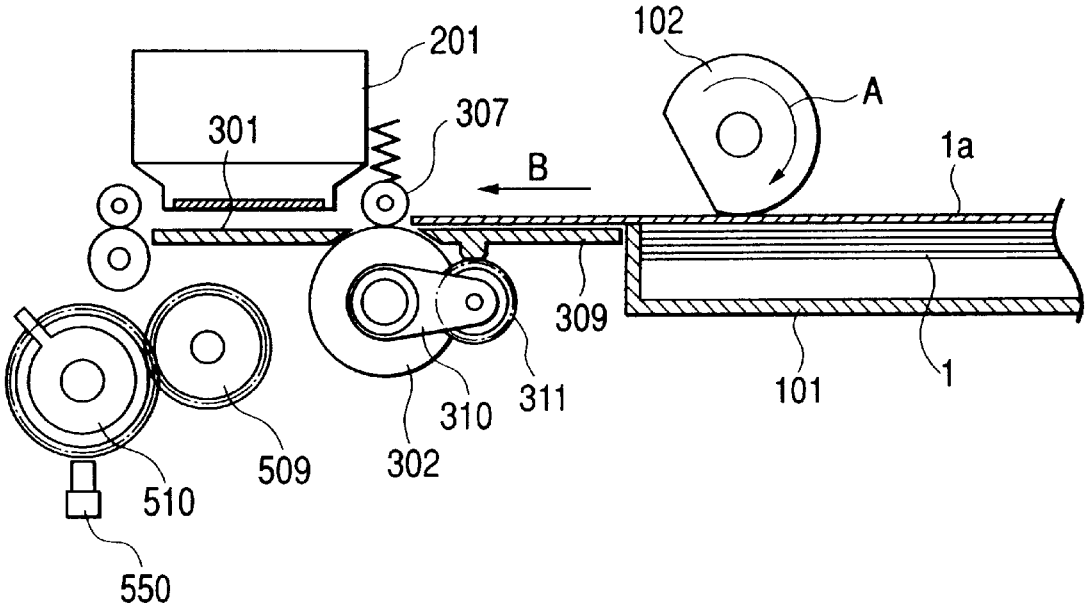
FIG. 9 is a typical side view illustrating the sheet feeding sequence in the prior art.
Figure 10:
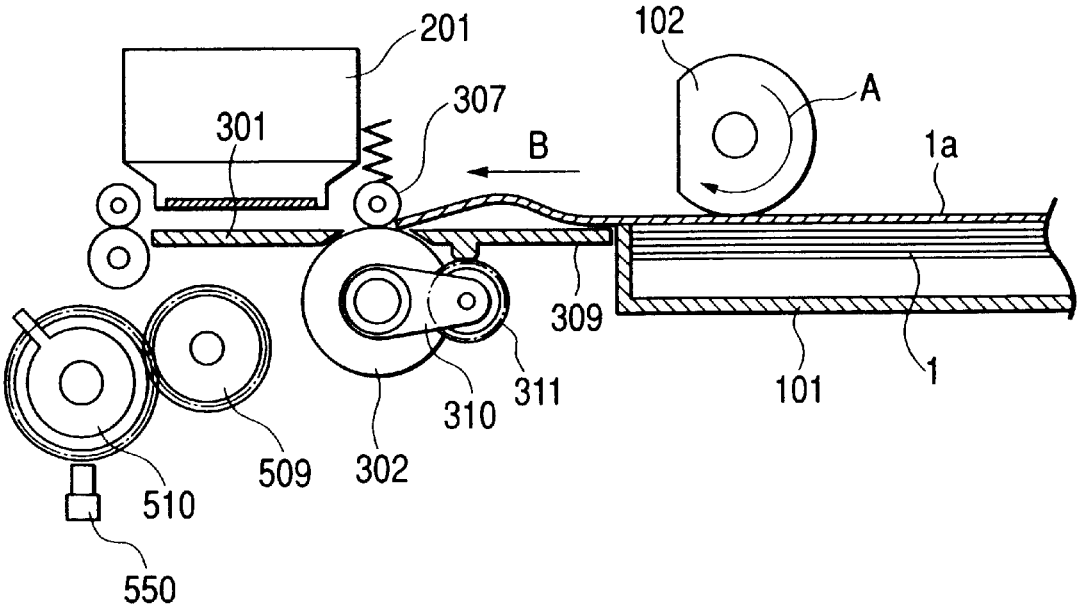
FIG. 10 is a typical side view illustrating the sheet feeding sequence in the prior art.
Figure 11:
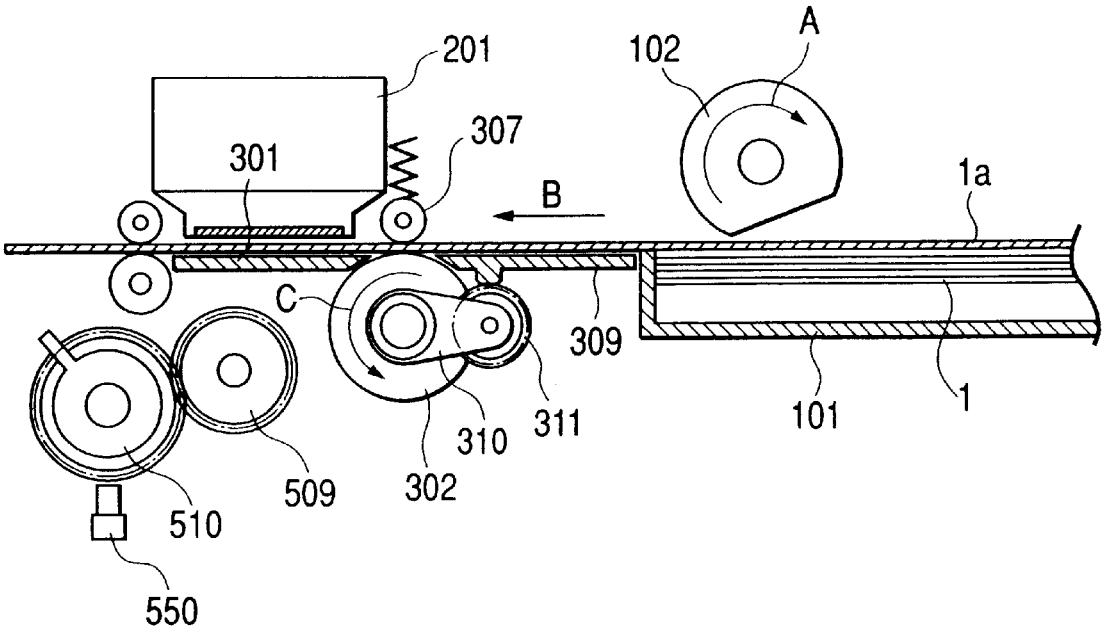
FIG. 11 is a typical side view illustrating the sheet feeding sequence in the prior art.
Figure 12:
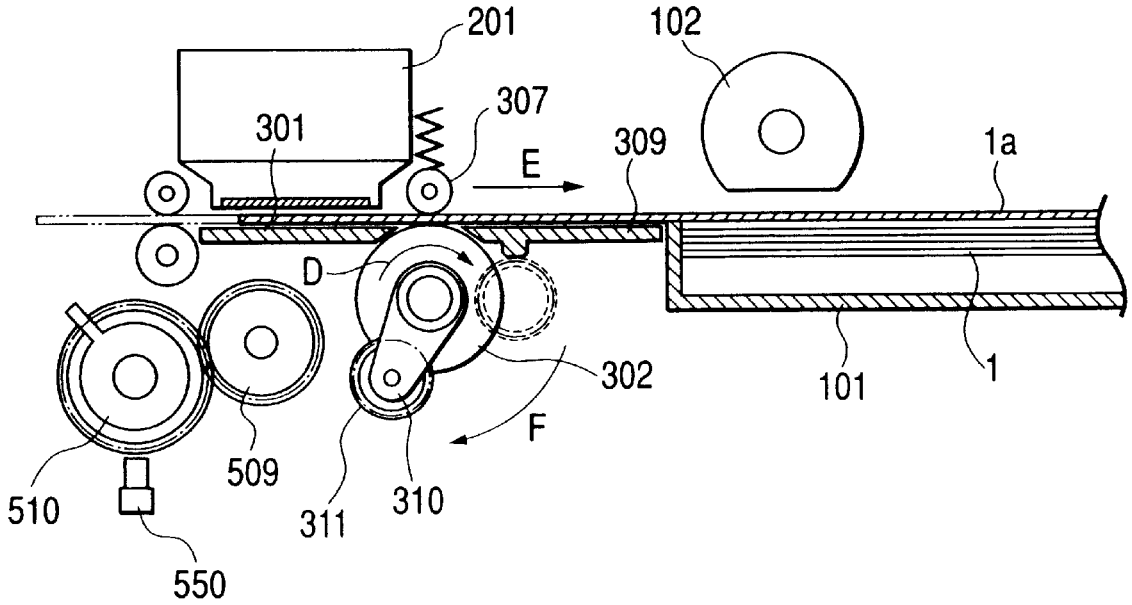
FIG. 12 is a typical side view illustrating the sheet feeding sequence in the prior art.
Figure 13:
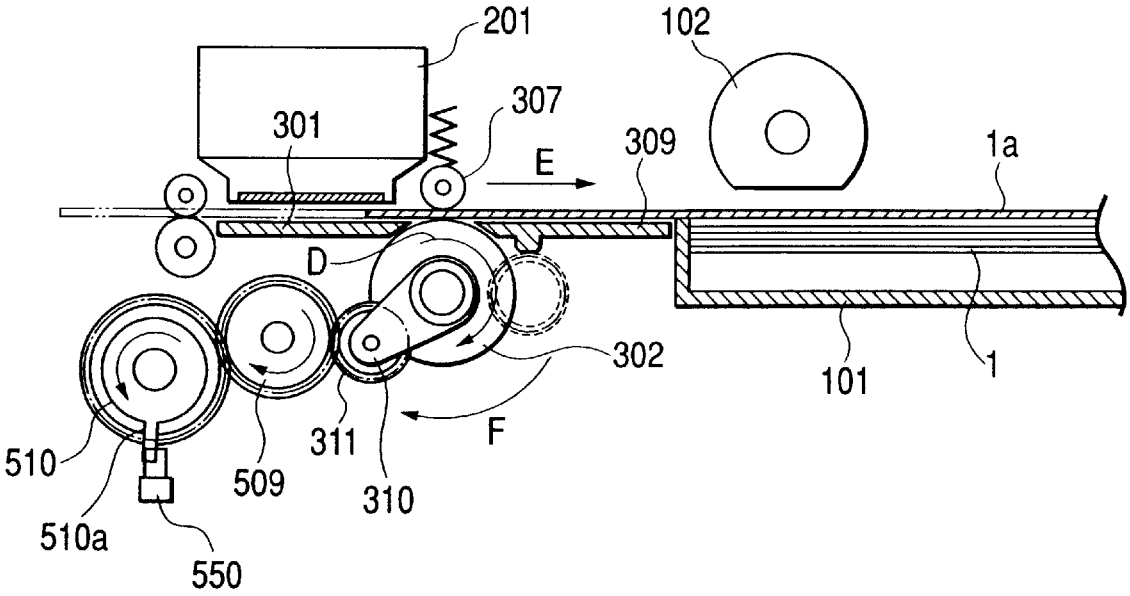
FIG. 13 is a typical side view illustrating the sheet feeding sequence in the prior art.

A third embodiment of the present invention will now be described with reference to FIG. 8. FIG. 8 is a typical side view illustrating the relation between the sheet feeding sequence in the third embodiment of the present invention and the transmission of the driving force to the pump.

In the present embodiment, when the amount of rotation of the conveying roller 302 necessary to return the uppermost sheet 1*a* excessively conveyed by the rotation of the sheet feeding roller 102 required for resetting to the recording start position (a distance L in FIG. 8) is defined as X1 and the amount of rotation of the conveying roller 302 required for the maximum amount of movement (a distance M in FIG. 8) of the LF pendulum arm 310 is defined as X2 and the amount of rotation of the conveying roller 302 required for the pump cam 510 to make one revolution (a distance R2 in FIG. 8) is defined as X3, design is made such that the relation that $$X1=(X2+X3)$$

is established.

That is, even if the conveying roller 302 is rotated in the reverse direction to return the uppermost sheet 1*a* to the cue position, the pump cam 510 makes one revolution by the amount of rotation at this time and returns to its original position which is the initial position and therefore no inconvenience occurs and moreover, it is possible to prepare for the next pumping operation without retaking the initial centering of the pump cam 510.

In this construction, it is feared that depending on the slipping state of the sheet or the state of the environment during sheet feeding, the excessive feed distance L of the sheet becomes non-uniform to a certain degree, but in such case, by applying the control of the forward rotation and reverse rotation of the conveying roller 302 based on the relation between the amount of rotation of the conveying roller 302 required for the movement of the pump cam 510 from the detection point of the position detecting sensor to the ordinary stop position of the pump cam 510 (R3 indicated in FIG. 8) and the amount of rotation of the conveying roller 302 corresponding to the remaining amount of return of the sheet, it becomes possible to realize the setting of the cue position of the sheet and the resetting of the initial position of the pump cam 510 at a time.

In each of the above-described embodiments, it is also possible to use not the pendulum mechanism enabling a large dead zone range of driving, but a spring clutch or a needle clutch almost free of the dead zone range, as the one-way drive changeover mechanism. In such case, the amount of rotation can be adjusted so as to rotate the pump cam 510 by two or more revolutions and return it to its original position.

<Other Embodiments>

The present invention brings about an excellent effect particularly in a recording head and recording apparatus of the type which is provided with means (such as an electrothermal converting member or a laser beam) for generating heat energy as energy utilized to effect ink discharge, and causes a change in the state of the ink by the heat energy, among the ink jet recording types. This is because according to such a type, the higher density and higher definition of recording can be achieved.

With regard to the typical construction or principle of this type, that which uses the basic principle disclosed, for example, in U.S. Pat. No. 4,723,129 and U.S. Pat. No. 4,740,796 is preferable. This type is applicable to both of the so-called on-demand type and the continuous type, and particularly in the case of the on-demand type, at least one driving signal corresponding to recording information and providing a rapid temperature rise exceeding nucleate boiling is applied to an electro-thermal converting member disposed correspondingly to a sheet or a liquid path in which liquid (ink or processing liquid) is retained to thereby generate heat energy in the electro-thermal converting member and cause film boiling in the heat-acting surface of a recording head with a result that a bubble in the liquid (ink or processing liquid) corresponding at one for one to this driving signal can be formed, and this is effective. By the growth and contraction of this bubble, the liquid (ink or processing liquid) is discharged through a discharge opening to thereby form at least one droplet. If this driving signal is made into a pulse shape, the growth and contraction of the bubble take place on the spot and appropriately and therefore, the discharge of the liquid (ink or processing liquid) excellent particularly in responsiveness can be achieved, which is more preferable. As this driving signal of the pulse shape, one as described in U.S. Pat. No. 4,463,359 and U.S. Pat. No. 4,345,262 is suitable. If the conditions described in U.S. Pat. No. 4,313,124 covering an invention relating to the temperature rise rate of the above-mentioned heat-acting surface are adopted, more excellent recording can be accomplished.

As regards the construction of the recording head, besides the combination construction (a straight liquid flow path or a right-angled liquid flow path) of the discharge port, the liquid path and the electro-thermal converting member as disclosed in each of the above-mentioned patents, a construction using U.S. Pat. No. 4,558,333 and U.S. Pat. No. 4,459,600 which disclose a construction in which a heat-acting portion is disposed in a bent area is also covered by the present invention. In addition, the present invention is also effective when it adopts constructions based on Japanese Patent Application Laid-Open No. 59-123670 which discloses a construction in which a slit common to a plurality of electro-thermal converting members is the discharge portion of the electro-thermal converting members and Japanese Patent Application Laid-Open No. 59-138461 which discloses a construction in which an opening absorbing pressure liquid of heat energy is made to correspond to a discharge portion. This is because whatever the form of the recording head may be, according to the present invention, recording can be effected reliably and efficiently.

In addition, even in the serial type like the above-described example, the present invention is also effective when use is made of a recording head fixed to the main body of the apparatus, or a recording head of the interchangeable chip type which is mounted on the main body of the apparatus, whereby the electrical connection to the main body of the apparatus and the supply of ink from the main body of the apparatus become possible, or a recording head of the cartridge type in which an ink tank is provided integrally with a recording head itself.

Also, it can more stabilize the effect of the present invention to add discharge recovering means for the recording head, preliminary auxiliary means, etc. to the construction of the recording apparatus of the present invention, and this is preferable. Specifically, as these means, mention can be made of capping means for the recording head, cleaning means, pressurizing or sucking means, preliminary heating means for effecting heating by the use of an electro-thermal converting member or a heating element discrete therefrom or a combination of these, and preliminary discharging means for effecting discharge discrete from that for recording.

Also, regarding the kind or number of the recording heads, there may be, for example, a single recording head corresponding to monochromatic ink, and a plurality of recording heads correspondingly to a plurality of inks differing in recording color or density. That is, for example, the recording mode of the recording apparatus is not limited to a recording mode of only a mainstream color such as black, but may be a recording mode provided by recording heads constructed integrally with each other or a combination of a plurality of recording heads, but the present invention is also very effective for an apparatus provided with at least one of the plural-color recording mode by different colors and the full color recording mode by mixed colors.

Further, while in the above-described embodiments, ink is described as the liquid, use may be made of ink solidified at room temperature or lower and softened or liquefied at room temperature, or use may be made of ink which assumes the liquid phase when a recording signal used is imparted, because in the ink jet system, generally the ink itself is temperature-adjusted within the range of 30° C. to 70° C. and is temperature-controlled so that the viscosity of the ink may be within a stable discharge range. In addition, in order to positively prevent the temperature rise by heat energy or to prevent the evaporation of ink by using the temperature rise as the energy for the state change of the ink from its solid state to its liquid state, use may be made of ink solidified when it is left as it is and liquefied by heating. At any rate, the present invention is also applicable when use is made of ink having the property of being liquefied only by the imparting of heat energy, such as ink liquefied by the imparting of heat energy conforming to a recording signal, and discharged in the form of liquefied ink, or ink which already begins to be solidified at a point of time whereat it arrives at a recording medium. The ink in such a case may be made to assume the form as described in Japanese Patent Application Laid-Open No. 54-56847 or Japanese Patent Application Laid-Open No. 60-71260 wherein the ink is opposed to an electro-thermal converting member in a state in which it is held as a liquid substance or a solid substance in the recesses or through-holes of a porous sheet. In the present invention, what is most effective for each of the above-described inks is what executes the above-described film boiling method.

Further, the form of the recording apparatus according to the present invention may be, besides the form used as the image output terminal of an information processing apparatus such as a computer, the form of a copying apparatus combined with a reader and further, the form of a facsimile apparatus having transmitting and receiving functions.

As described above, according to the present embodiment, the apparatus has a drive source rotatable in forward and reverse directions, and drive changeover means for transmitting the driving force of the drive source, the drive changeover means drives the conveying roller by the rotation of the drive source in the forward direction and drives the recovery system by the rotation of the drive source in the reverse direction, and prevents the malfunctioning of the recovery system even when the conveying roller is driven by the rotation of the drive source in the reverse direction, and therefore, by a simple construction, any inconvenience regarding the initial position of the recovery system is prevented from occurring even if the reverse rotation of the conveying roller for returning an excessively fed sheet is effected in a construction wherein the conveying roller and the recovery system shares a drive source.

What is claimed is:

1. An image forming apparatus for forming an image on a recording medium by recording means, said apparatus including a first mechanism and a second mechanism, said apparatus comprising:

a drive source rotatable in forward and reverse directions; and drive changeover means for transmitting a driving force of said drive source, said drive changeover means (i)

driving the first mechanism by the rotation of said drive source in the forward direction, (ii) driving the second mechanism by the rotation of said drive source in the reverse direction, and (iii) preventing the malfunctioning of the second mechanism even when the first mechanism is driven by the rotation of said drive source in the reverse direction.

2. An image forming apparatus according to claim 1, wherein the first mechanism is conveying means for conveying the recording medium.

3. An image forming apparatus according to claim 1, wherein the second mechanism is recovering means for effecting a recovering process of the recording means.

4. An image forming apparatus for forming an image on a recording medium by recording means, comprising:

a conveying rotary member for conveying the recording medium;

a drive source rotatable in forward and reverse directions, said drive source supplying a rotative driving force in a first direction to said conveying rotary member by rotation in a forward direction, supplying a rotative driving force in a second direction opposite to the first direction to said conveying rotary member and supplying a driving force to a driven portion by rotation in a reverse direction; and one-way drive transmitting means for transmitting the driving force to said driven portion when said drive source is rotated in the reverse direction, said one-way drive transmitting means including a drive dead zone range by which said one-way drive transmitting means does not transmit the driving force of said drive source rotated in the reverse direction to said driven portion for a predetermined amount after the direction of rotation of said drive source is changed over from the forward direction to the reverse direction, wherein the amount of rotation of said drive source necessary to rotatively drive said conveying rotary member in the second direction to perform a predetermined operation is smaller than the drive dead zone range.

5. An image forming apparatus according to claim 4, wherein said one-way drive transmitting means is a pendulum-shaped gear transmission mechanism including a base gear, a pendulum arm mounted for pivotal movement relative to said base gear, and a planetary gear mounted on said pendulum arm, and the drive dead zone range is a movement range of said pendulum-shaped gear transmission mechanism from a position remote from said driven portion to a position engaged with said driven portion.

6. An image forming apparatus according to claim 4, wherein said conveying rotary member effects an ordinary conveyance of the recording medium by said drive source rotatively driving said conveying rotary member in the first direction, and said conveying rotary member effects an adjustment of the conveyance of the recording medium by said drive source rotatively driving said conveying rotary member in the second direction.

7. An image forming apparatus according to claim 4, wherein said driven portion is recovering means for effecting maintenance of said recording means.

8. An image forming apparatus according to claim 7, wherein said recording means is recording means of an ink jet type having a discharge port for discharging ink therethrough, and said recovering means comprises a suction pump for removing any substance hindering a discharge function from said discharge port and a vicinity thereof, and a driving cam for driving said suction pump by the driving force transmitted through said one-way drive transmitting means.

9. An image forming apparatus for forming an image on a recording medium by recording means, comprising:

a conveying rotary member rotatable in a first direction and a second direction opposite to the first direction to convey the recording medium;

a cam mechanism rotatively driven to thereby effect driving of a predetermined mechanism;

a drive source for supplying a rotative driving force to said conveying rotary member and said cam mechanism;

position detecting means for detecting an initial position of said cam mechanism in the rotation thereof; and one-way drive transmitting means for transmitting the rotative driving force from said drive source to said cam mechanism when said conveying rotary member is rotated in the second direction, wherein when said one-way drive transmitting means transmits the driving force to said cam mechanism by the rotation of said conveying rotary member in the second direction, the positions at which said cam mechanism is rotated by said one-way drive transmitting means and stopped are within a range outside a range required for said position detecting means to detect the initial position of said cam mechanism.

10. An image forming apparatus according to claim 9, wherein an amount by which said cam mechanism is rotated within the range outside the range required for the detection of the initial position is greater than the amount of rotation of said conveying rotary member in the second direction, whereby the stop position is within a range outside the range required for the detection of the initial position.

11. An image forming apparatus according to claim 9, wherein by the rotation of said conveying rotary member in the second direction, said cam mechanism effects one or more full rotations and returns to the initial position, wherein the stop position is within the range outside the range required for the detection of the initial position.

12. An image forming apparatus according to claim 9, further comprising a sheet feeding rotary member having a dead zone portion which does not contact with the recording medium and for feeding the recording medium to said conveying rotary member, and wherein the rotation of said conveying rotary member in the second direction is a rotation for conveying the recording medium conveyed by said sheet feeding rotary member effecting two full rotations in the opposite direction.

13. An image forming apparatus according to claim 9, wherein the initial position of said cam mechanism is provided near an initial position detection area of said cam mechanism by said position detecting means.

14. An image forming apparatus according to claim 9, wherein said recording means is a recording head for discharging ink to the recording medium to thereby form an image thereon, and is provided with recovering means for effecting a recovering process for maintaining a discharging function of the recording head, and said recovering means includes said cam mechanism.

15. An image forming apparatus according to claim 14, wherein said cam mechanism is a pump cam for driving a suction pump of said recovering means.

16. An image forming apparatus according to claim 14, wherein said recording head creates a bubble in the ink by the utilization of heat energy, and discharges the ink by the pressure of the bubble.

* * * * *